US006065620A

United States Patent [19]

McGhie

[11] Patent Number: 6,065,620

[45] Date of Patent: May 23, 2000

[54] MOVABLE SHEAVE ASSEMBLY FOR A CRANE

[75] Inventor: James McGhie, Eagan, Minn.

[73] Assignee: Trans World Crane, Incorporated, Eagan, Minn.

[21] Appl. No.: 09/049,242

[22] Filed: Mar. 27, 1998

[51] Int. Cl.[7] ..... B66C 23/74

[52] U.S. Cl. ..... 212/298; 212/178; 212/196; 212/270; 212/198

[58] Field of Search ..... 212/178, 298, 212/301, 196, 198, 195, 270

[56] References Cited

U.S. PATENT DOCUMENTS

| | | | |
|---|---|---|---|
| 3,140,857 | 7/1964 | Nickles . | |
| 3,557,968 | 1/1971 | Thaeter . | |
| 3,664,516 | 5/1972 | Goudy | 212/298 |
| 3,814,264 | 6/1974 | Frick . | |
| 4,197,953 | 4/1980 | Frick . | |
| 4,201,305 | 5/1980 | Frick . | |
| 5,018,630 | 5/1991 | McGhie . | |
| 5,035,337 | 7/1991 | Juergens . | |
| 5,222,613 | 6/1993 | McGhie . | |
| 5,586,667 | 12/1996 | Landry . | |

FOREIGN PATENT DOCUMENTS

| | | | |
|---|---|---|---|
| 268458 | 5/1989 | Germany | 212/196 |
| 1018695 | 2/1966 | United Kingdom | 212/178 |
| 1072910 | 6/1967 | United Kingdom | 212/196 |

*Primary Examiner*—Thomas J. Brahan
*Attorney, Agent, or Firm*—Douglas J. Christensen

[57] ABSTRACT

A convertible crane with a movable sheave assembly which is operable in two distinct positions. In the first position, the sheave is adjacent the body of a crane to enable it to operate in relatively restricted space without interference from obstacles adjacent the rear end of the base. In the second position, the sheave extends away from the body of a crane where it may be attached to an auxiliary counterweight to enable a crane to lift larger loads. The movable sheave assembly enables a crane to be easily and rapidly converted between normal and enhanced lifting modes.

19 Claims, 5 Drawing Sheets

MOVABLE SHEAVE ASSEMBLY FOR A CRANE

BACKGROUND OF THE INVENTION

The present invention relates generally to lifting cranes used in the construction industry, and more particularly to mobile cranes having main and auxiliary counterweights.

Most crane companies typically have one or more general, all-purpose truck cranes or crawler cranes which are usable in the majority of lifting and moving projects encountered in a typical construction project. Owing to physical and legal requirements concerning length, height, weight, etc., such cranes usually must be partially disassembled in order to be moved between job sites.

Cranes of this type are disclosed, for example, in U.S. Pat. No. 5,035,337 to Juergens, U.S. Pat. No. 5,586,267 to Landry, and U.S. Pat. No. 5,222,613 to McGhie.

The above mentioned cranes typically include: a wheeled or crawler mounted base; a platform pivotally mounted on the base for rotation about a vertical axis; a boom pivotally mounted on a forward end of the platform for rotation about a horizontal axis, the boom having an end projecting upwardly and forwardly relative to the platform; a load line having two ends, with one end connected to a winch mounted on the platform, the other end passing over the end of the boom and connected to a load; and a counterweight attached to the rearward end of platform to counteract the tilting effect or moment arm created by the boom and a weight to be lifted.

Cranes of the type described above may also be provided with an auxiliary counterweight assembly to offset tilting effects imposed by extremely large loads. For example, the above mentioned Juergens U.S. Pat. No. 5,035,337 discloses a crane having an auxiliary counterweight which, along with a main counterweight, is attached to a spar which extends rearwardly from a platform. A first end of the spar is pivotally attached to the platform while a second end is attached to a boom via a pendant. Note that the auxiliary counterweight is normally ground supported, and for that reason, the second end of the spar must extend beyond the platform and base of the crane. In response to lifting a heavy load, a load line exerts a bending moment on the boom which, by virtue of the pendent, exerts a bending moment on the spar. The spar, which has a limited or lost range of motion, reacts by lifting both the main counterweight and the auxiliary counterweight to counteract the heavy load. The problem with cranes of this type is that main counterweight, the auxiliary counterweight and the spar combine to create a large tail swing which prevents the crane from operating in restricted spaces without interference from obstacles adjacent the rear end of its wheeled base. Even when the auxiliary counterweight is removed, the spar and its associated main counterweight still project rearwardly beyond the platform and the base of the crane to create a large tail swing. Additionally, the auxiliary counterweight, the main counterweight and the spar must be assembled and disassembled each time the crane is moved. This means that there are considerable periods of time when the crane is not generating income.

The crane of Landry U.S. Pat. No. 5,586,667 is similar to Juergens except for the design of the spar. In Landry, the spar is separated into two parts, a main spar and a spar tip. The main spar has first and second ends with the first end rigidly attached to the platform and the second end providing a pivot attachment point for the spar tip. The spar tip also has first and second ends, with the first end pivotally attached to the second end of the main spar. The second end of the spar tip functions as an attachment point for an auxiliary counterweight and as an attachment to the boom end of the crane. Motion between the main spar and the spar tip is limited by a lost motion connection. As in the patent to Juergens, Landry attaches the main and auxiliary counterweights to the spar. And, as in Juergens, Landry has the same disadvantages of a large tail swing and extended assembly/disassembly time.

In McGhie U.S. Pat. No. 5,222,613, an auxiliary counterweight system is removably connected to a platform of a crane via pivot pins and a boom hoist rope. The system comprises a counterweight carriage, a counterweight, and a coupling means. The coupling means is in the form of a yoke and includes yoke extensions with pivot pin apertures and a sheave bracket mount with sheaves rotatably mounted thereto. To attach the system, pivot pins are inserted into the pivot pin apertures and apertured ears which project from the crane and which are aligned therewith. Then the boom hoist rope is re-reeved about the sheaves in the sheave bracket mount. This crane is capable of operating without the auxiliary counterweight. However, in order to make such a conversion, the boom hoist rope must be disengaged from the sheave bracket mount and re-reeved about the platform sheaves, the pivot pins must be withdrawn from the pivot pin apertures and apertured ears of the crane, and the coupling means removed. This procedure takes time. If the coupling means is not removed, tail swing remains unnecessarily large and potentially dangerous.

For the foregoing reasons, there is a need for a crane that can operate in relatively restricted space without interference from obstacles adjacent the rear end of its base, and whose lift capacity can be easily and rapidly changed without disassembly in response to varying conditions.

SUMMARY OF THE INVENTION

The present invention is directed to a movable sheave assembly which is operable in two distinct positions. In the first position, the sheave is adjacent the body of a crane for lifting low to moderate loads and enabling it to operate in relatively restricted space without interference from obstacles adjacent the rear end of the base. In the second position, the sheave extends away from the body of a crane where it may be attached to an auxiliary counterweight to enable a crane to lift larger loads.

The movable sheave assembly comprises a sheave rotatably retained by a support structure comprising first and second arms. The sheave is operable in a first position where the first and second arms are fixed relative to the body of a crane. The sheave is also operable in a second position where the first and second arms may move relative to the body of a crane. More specifically, a sheave is rotatably mounted on an axle supported by flanges which extend from the surface of a plate. The plate, in turn, is attached to the support structure (i.e., first and second arms) by first and second apertured projections which extend from the surface of the plate and through the body of the arms until they are adjacent apertured lugs on the first and second arms, where they are pin connected to each other to form the movable sheave assembly or yoke.

The ends of the arms are movably coupled to the body of a crane to enable the sheave to translate or move between a first and second operable positions.

When the movable sheave assembly or yoke is in the first position, the support structure (i.e., the first arm and the second arm) and sheave are adjacent the body of a crane. In this first position, the yoke is releasable attached to the body of a crane by pins which engage apertures in flanges which extend from the plate, and apertures in ears on the body of a crane. In this compact configuration, tail swing is significantly reduced and the crane is able to operate normally in a relatively restricted space.

When the movable sheave assembly or yoke is in the second position, the support structure (i.e., the first arm and the second arm) and sheave extend away from the body of a crane. In this second position, an auxiliary counterweight may be attached to the yoke. More specifically, an auxiliary counterweight may be releasable attached to the plate in the same manner that the plate is attached to the first and second arms. That is, an auxiliary counterweight is attached to the plate by apertured projections which extend from a surface thereof through the body of the plate until they are adjacent apertured lugs on the plate, where they are pin connected to each other. Although any suitable auxiliary counterweight may be utilized, the preferred auxiliary counterweight used with this movable sheave assembly is of the self supporting, wheeled type.

In order to utilize the auxiliary counterweight effectively, motion of the yoke is restricted. The restricted motion is accomplished by first and second telescoping struts whose ends are connected to the first and second arms and the body of a crane, respectively. More specifically, each telescoping strut comprises a sleeve with opposing slots and an inner tube or rod with a transverse aperture. The sleeve slots and the transverse inner tube aperture are aligned with each other and secured with a pin or bolt which extends beyond the exterior wall of the sleeve. Thus, motion between the sleeve and inner tube, and the yoke may be limited. The resulting limited range of motion enables a wheeled auxiliary counterweight to ride along the ground when loads are relatively small, and to be engaged when loads are relatively large. The limited motion also prevents the auxiliary counterweight from swinging downwardly towards the body of a crane should the wheels of the auxiliary counterweight encounter a large hole or depression. Additionally, the limited motion also prevents the auxiliary counterweight from losing its effectiveness by being drawn towards the body of a crane in response to tipping.

Note that when the yoke or movable sheave assembly is moved between the first and second positions, the boom hoist line which extends from the crane to the mast and to the sheave does not have to be re-routed (re-reeved), thus the process of conversion between normal and enhanced lifting modes is considerably simplified and accelerated.

Further note that as the yoke is moved between the first and second positions, the struts do not have to be completely removed. Rather, only the end of the strut attached to the crane body need be disengaged, that end being movingly supported by a roller attached to the crane body.

A principal object and advantage of the present invention is to increase the lifting capacity of a counterbalanced, counterweighted crane.

Yet another object of the invention is to minimize setup and breakdown time of a high lift capacity crane.

Another object and advantage of the invention is to eliminate the need to re-reeve a crane as it is converted from a normal to an enhanced capacity mode of operation.

Another object and advantage of the invention is to reduce the tail swing of a crane.

Still another object and advantage of the invention is a method by which the crane itself is used to attach an auxiliary counterweight to itself.

These and other objects, features, and advantages of the invention will become more readily apparent to those skilled in the art from the detailed description and the accompanying drawings.

DETAILED SPECIFICATION

The present invention utilizes many of the standard elements found on a truck crane, crawler crane or fixed crane assembly. Although the invention as described herein is with reference to the truck-mounted crane assembly of the counterbalance type, it should be understood that the necessary elements are also found on other types of cranes which may easily be available for use with convertible, pivotally-mounted, movable sheave assembly and auxiliary counterweight system of the present invention.

Figure 1:
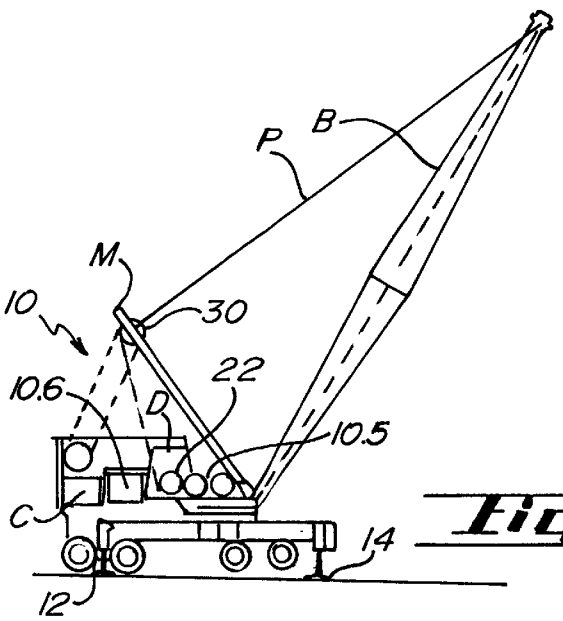
FIG. 1 is a side elevational view of a crane in a normal lifting configuration.

Referring to FIG. 1, a truck mounted crane is generally indicated as 10. The crane 10 is of a conventional design having a ground-borne base G, a body D rotatably mounted about a vertical axis on a ground-borne base, the body D having a forward end 10.5 and a rearward end 10.6, a boom B pivotally extending upwardly and forwardly from the forward end of the body D, a mast M pivotally extending upwardly from the body D, a pendent or fixed length rope P connecting the boom B and the mast M, and a main counterweight C attached adjacent to the rearward end of the body D. The truck illustratively has wheels 12, and outriggers 16. Outriggers may be into contact with the ground, stabilizing the crane, or retracted upwardly for transport of the crane. In this figure, the crane is in its standard operating configuration or position wherein a movable sheave assembly 40 is maintained in a first position adjacent the rearward end of the platform of the crane. In this configuration, one end of a running rope 20 is attached to a winch 22. From there, it extends upwardly and is reeved about mast sheave 30, then downwardly about movable sheave assembly 40 and upwardly again. This reeving may be iterated depending upon the number of pulleys used in the mast and movable sheave assemblies, with the second end of running rope tied off in the usual manner. Because mast M is connected to boom B by pendant P, tangential movement of boom B is controlled by running rope 20 as it is played out or retracted by the winch, in a motion otherwise known as luffing. Although mast M is depicted as being pivotally attached to the body of a crane, i.e., a floating mast, it is understood that the sheave assembly may be used on cranes with fixed masts or no masts.

In those instances where an object to be lifted exceeds the normal, safe lifting capacity of the crane, the crane may be converted or enhanced by providing an auxiliary counterweight 45.

Figure 2:
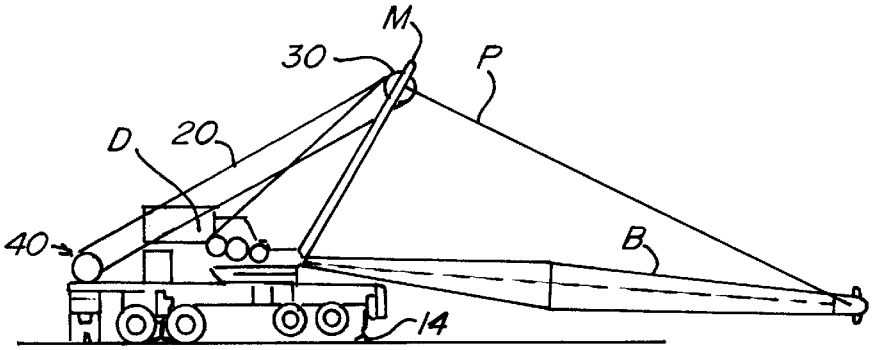
FIG. 2 is a side elevational view of the crane with the boom lowered.
Figure 5:
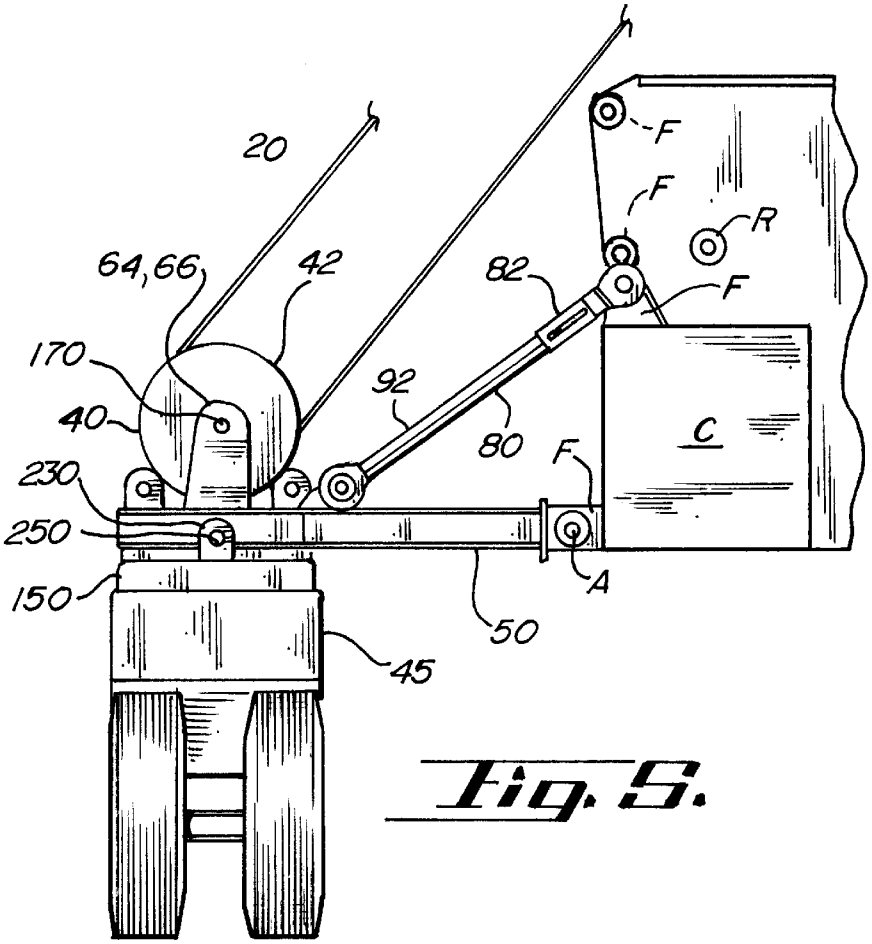
FIG. 5 is a side view of the yoke or movable sheave assembly attached to an auxiliary counterweight.

Referring to FIGS. 2 and 5, boom B has been lowered in preparation of attaching an auxiliary counterweight 45. Boom B is lowered to a point where it is supported by the ground. Lowering is accomplished by playing out running rope 20 so that mast M is able to pivot about a first horizontal axis. Although not shown, movable sheave assembly 40 is maintained adjacent the crane body during this step. Once boom B is resting on the ground, auxiliary counterweight 45 is placed in position. Movable sheave assembly 40 is then disengaged from the body of the crane and allowed to translate or move towards the auxiliary counterweight 45 to a second position spaced away from and extending beyond the rearward end of the platform of the crane. Note strut 80, one end of which is connected to movable sheave assembly 40, the other end disengaged from the body of a crane and supported for movement by roller R.

Figure 3:
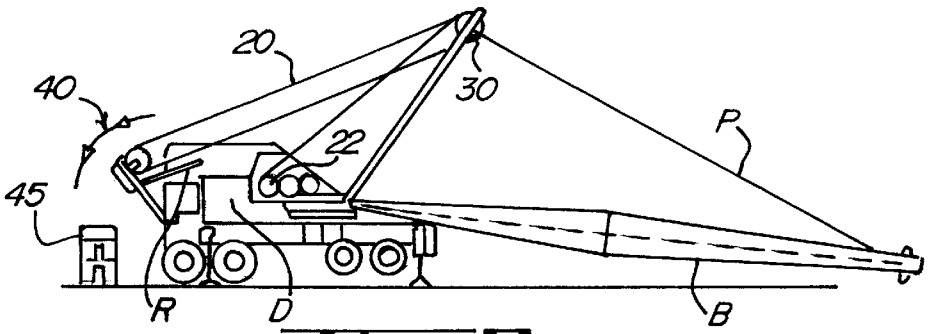
FIG. 3 is a side elevational view of the crane with the movable sheave assembly being lowered for attachment to an auxiliary counterweight.

Referring to FIGS. 3 and 5, auxiliary counterweight 45 is attached to movable sheave assembly 40 and struts 80 are attached between the movable sheave assembly 40 and the body of the crane. The boom B is now ready to be elevated into its enhanced operational position. This is accomplished by retracting running rope 20 which extends between mast 30 and movable sheave assembly 40.

Lowering and raising is accomplished by actuating the "boom raise" or "boom lower" lever in operator cab. The boom will not raise or lower due to the arm being lighter than the boom. You pay-out with the boom hoist rope and arm will lower. Pay-in with the boom hoist rope and arm will raise.

Figure 4:
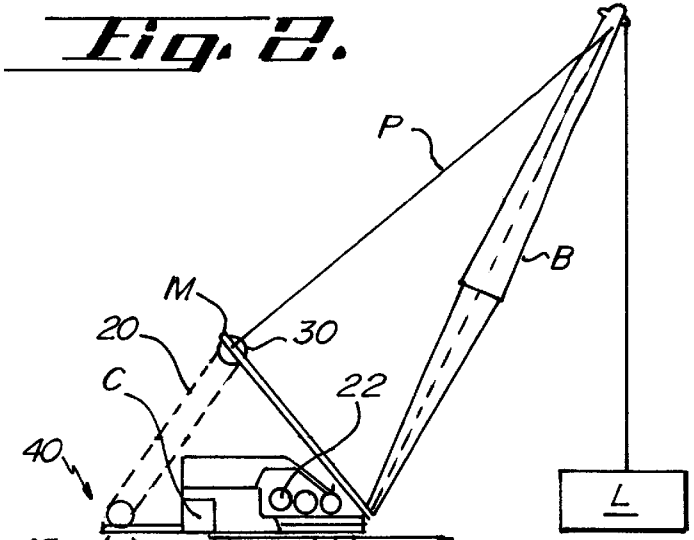
FIG. 4 is a side elevational view of the crane in the enhanced lifting configuration.

Referring to FIG. 4, the crane is shown in its enhanced operating configuration. As a heavy object, a load L is elevated, force exerted on boom B is translated via pendant P to mast M and to running rope 20. The sheave is thus linked to the load by way of running rope 20 and pendant P. In reaction, movable sheave assembly 40 and attached auxiliary counterweight 45 will be drawn towards the body of the crane. This motion, however, is constrained by struts 80 which have limited telescoping motion. In the absence of an abnormal load, the auxiliary counterweight may rest upon its own support, in this case wheels. Thus, once a crane is in this configuration, it may be used for both normal and enhanced loads.

Referring to FIG. 5, movable sheave assembly 40 is depicted in the second position as it is attached to an auxiliary counterweight 45. Movable sheave assembly 40 includes a support structure 48 which comprises a pair of arms 50, each arm 50 comprises a first end 52 and a second end 62, with a head formed at the first end 52 formed into a bracket or mounting ears 54, 56 with apertures or holes 58, 60 extending therethrough. The bracket or ears 58, 60 are readily alignable with flanges F on the body of a crane after which pins A may be located and fastened there at to secure this arrangement. The second end of each of the arms 50 includes a lug 64, 66 having apertures 68, 70 which align with apertures 166, 168 of projections which extend outwardly from a plate 150 and are releasable retained by pins 170 (see FIGS. 9A, 9B, and 9C). Plate 150 also includes a pair of flanges (not shown) which extend outwardly therefrom and which rotatably support sheave 42, with sheave 42 connected via running rope 20 to the mast of a crane.

Motion of movable sheave assembly 40 is limited by telescoping struts or stays 80. Each strut 80 consists of a sleeve 82 and an inner tube or rod 92. Sleeve 82 includes a head formed into a mounting ear or bracket 88 provided with an aperture or hole 90 extending therethrough readily alignable with a corresponding ear or bracket F on a crane (not shown) by suitable pins A. Inner tube or rod 92 has a head formed into a mounting bracket or ear 94 provided with an aperture or hole 96 extending therethrough readily alignable with arm flange 74, 76 after which pin 97 suitably may be located and fastened there at to secure this arrangement (see FIGS. 8A and 8B). The struts 80 are placed between the arms 50 and the body of the crane to limit motion of movable sheave assembly 40.

Figure 6:
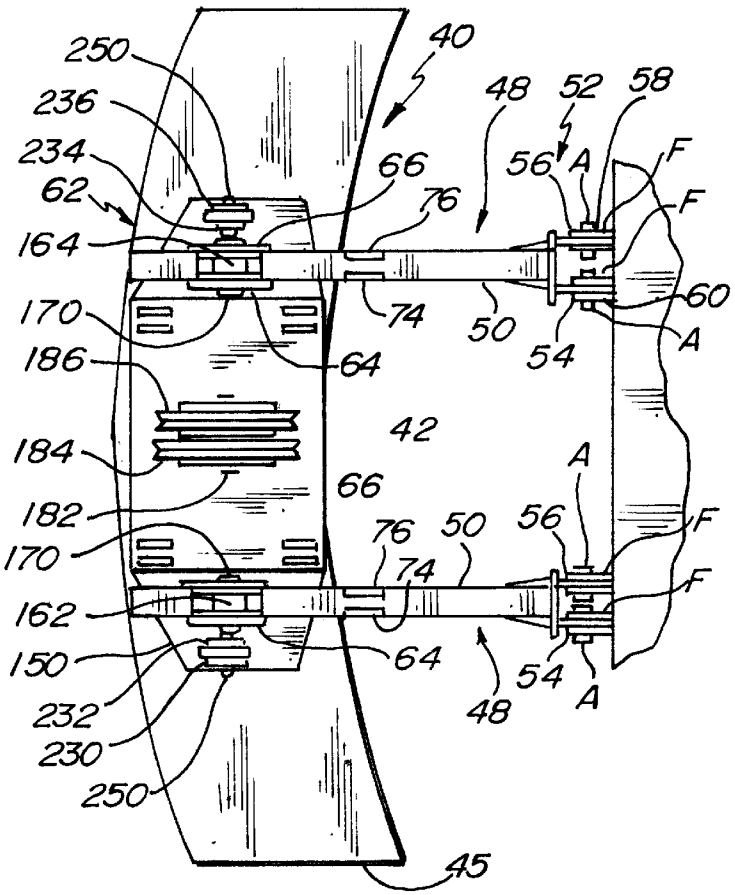
FIG. 6 is a partial top plan view of the yoke or movable sheave assembly and an auxiliary counterweight, sans struts.

Referring to FIG. 6, the movable sheave assembly 40 includes a support structure 48 which comprises a pair of arms 50, each arm 50 comprises a first end 52 and a second end 62, with a head formed at the first end 52 formed into a bracket or mounting ears 54, 56 with apertures or holes 58, 60 extending therethrough. The bracket or ears 58, 60 are readily alignable with apertures in flanges F on the body of a crane. Apertures in brackets 54, 56 and F are readily alignable after which pins A may be located and fastened there at to secure this arrangement. The second end of each of the arms 50 includes a lug 64, 66 having apertures 68, 70 which aligned with apertures 166, 168 of projections which extend outwardly from a plate 150 and are releasable retained by pins 170 (see FIGS. 9A, 9B, and 9C). The plate 150 is affixed to arms 50 serves two purposes. The first is to provide a point of attachment for the sheave adjacent the body of the crane, and the second is to provide a point of attachment for an auxiliary counterweight thereto. The arms 50 of support structure 48 and plate 150 form the movable sheave assembly or yoke. The attachments between the arms 50 and the plate 150 have some play in them so that auxiliary counterweight 45 is able to track uneven surfaces.

Although any suitable auxiliary counterweight may be used, the preferred auxiliary counterweight is of the wheeled type. More specifically, the auxiliary counterweight includes a plurality of support wheels which are arcuately aligned to permit the auxiliary counterweight to move in an arcuate or tangential fashion as the platform of the crane and crane body rotates about it's vertical axis (see FIGS. 1–6).

The configuration of the movable sheave assembly 40 will now be discussed in greater detail.

Figure 7A:
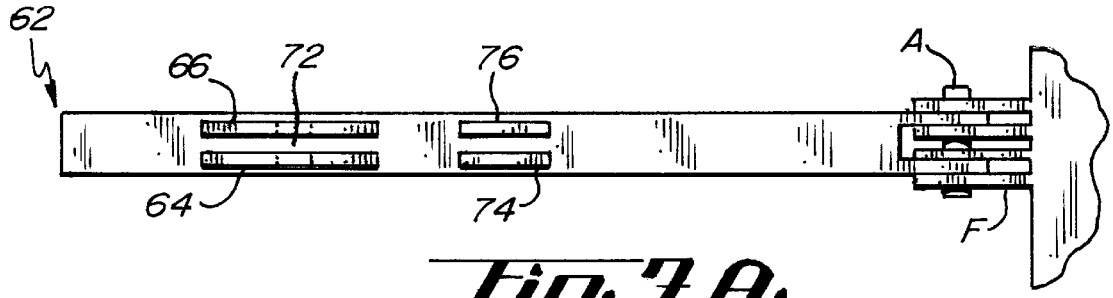
FIG. 7A is a top plan view of an arm of the yoke or movable sheave assembly.
Figure 7B:
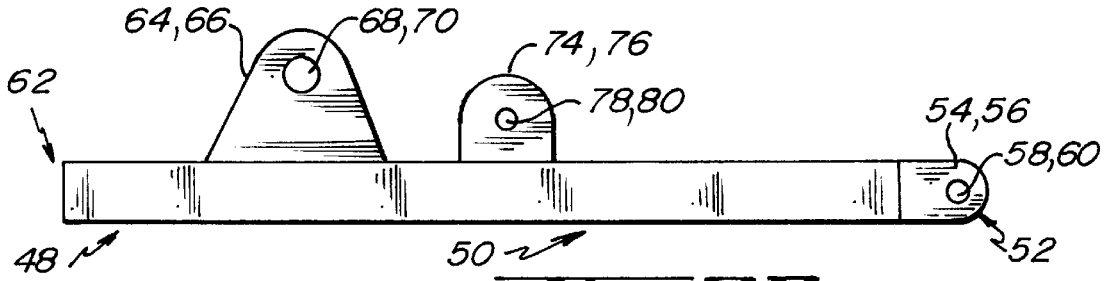
FIG. 7B is a side elevational view of the arm of FIG. 7*a*.

Referring to FIGS. 7A and 7B, yoke or movable sheave assembly 40 includes a support structure 48 which comprises a pair of arms 50, only one of which will be described. Arm 50 comprises a first end 52 and a second end 62, with a head formed at the first end 52 formed into a bracket or mounting ears 54, 56 with apertures or holes 58, 60 extending therethrough. The bracket or ears 54, 56 are readily alignable with flanges F on the body of a crane (not shown). The brackets 54, 56 are readily alignable after which pins A may be located and fastened there at to secure this arrangement. By this arrangement, arm 50 may be rotated about pin A, and the second end 62 of arm 50 may be positioned adjacent the body of a crane or extending away from the body of a crane. The second end 62 of the arm has lugs 64, 66 which extend therefrom, the lugs 64, 66 having apertures 68, 70 extending therethrough, and through hole 72. Lug apertures 68, 70 are sized to accept a pin or bolt 170 which engages an aperture 166 in a projection 162 which extends from a plate 150 which supports a sheave(s) (see FIG. 9*c*). Thus, as arm 50 is rotated about pin, movable sheave assembly 40 translates from a position adjacent the body of a crane to a position extending away from the body of a crane. Adjacent the second end 62 of arm 50 are flanges 74, 76 which extend from the arm, flanges 74, 76 having apertures 78, 80 extending therethrough, and sized to be readily alignable with aperture 96 of ear 94 of strut 80 which extends between the body of the crane and arm 50, after which pins 97 may be located and fastened there at to secure this arrangement.

The configuration of the strut or stay 80 will now be discussed in greater detail.

Figure 8A:
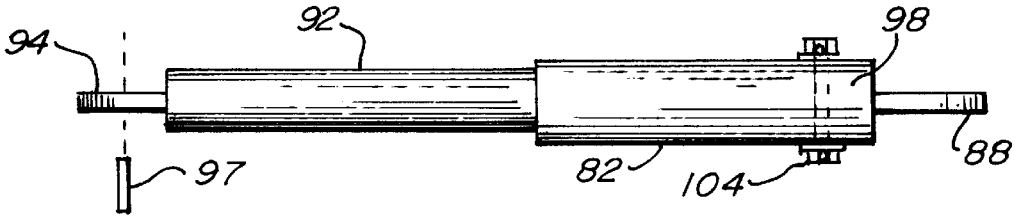
FIG. 8A is a top plan view of a strut in the retracted state.
Figure 8B:
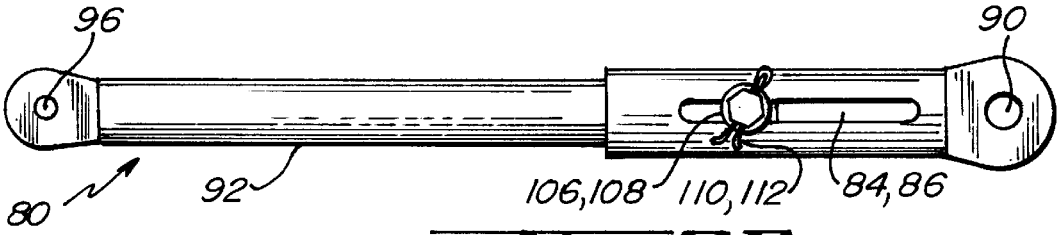
FIG. 8B is a side elevational view of the strut of FIG. 8*a* in the extended state.
Figure 8C:
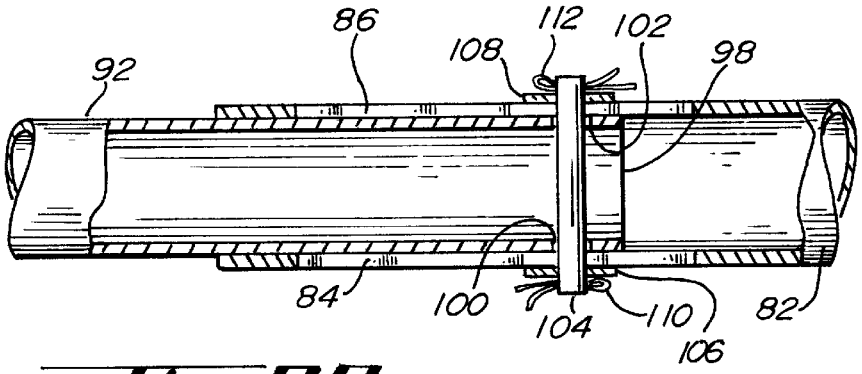
FIG. 8C is a partial cross-sectional view of the sleeve, rod, and pin.

Referring to FIGS. 8A, 8B and 8C, a strut 80 is of a linear expansible design which limits both the downward and upward range of movements of the movable sheave assembly 40 and associated auxiliary counterweight 45 when it is in the second or enhanced lift position. Strut 80 consists of a sleeve 82 having opposing slots 84, 86 intermediately arranged therethrough. Sleeve 82 has a head formed into a mounting ear or bracket 88 provided with an aperture or hole 90 extending therethrough. The bracket or ear 88 is readily alignable with a corresponding ear or bracket F on a crane (not shown). The brackets are readily alignable after which pins A suitably may be located and fastened there at to secure this arrangement. Within sleeve 82 slides a rod or inner tube 92. Rod or tube 92 has a head formed into a mounting bracket or ear 94 provided with an aperture or hole 96 extending therethrough. Ear or bracket 94 is readily alignable with arm flange 74, 76 after which pin 97 suitably may be located and fastened there at to secure this arrangement. Tube or Rod 92 also has inner end 98 having opposing apertures 100, 102, the opposing apertures 100, 102 and the sleeve slots 84, 86 alignable and configured to accept a pin or bolt 104 therethrough, wherein the pin or bolt extends beyond the exterior walls of the sleeve 82 and limits the relative motion between sleeve 82 and rod 92. As shown in FIG. 8C, pin or bolt 104 can be conventionally secured to the strut by washers 108, 108 and cotter pins 110, 112. However, other connections such as threaded nuts and bolts, for example, are envisioned.

By this arrangement, movable sheave assembly 40 and associated auxiliary counterweight 45 downward movement may be limited by the outward linear expansion of rod 92 to the point where pin or bolt 104 reaches end of slots 84, 86, as shown in FIG. 8B. Conversely, upward movement of movable sheave assembly 40 and associated auxiliary counterweight 45 in reaction to a load may be limited the inward linear retraction of rod 92 to where pin or bolt 104 reaches other ends of slots 84, 86, as shown in FIG. 8A. By this arrangement, movable sheave assembly 40 and associated auxiliary counterweight 45 have a limited upward movement which may come into play as auxiliary counterweight 45 is lifted off the ground.

Although telescoping struts are shown, it is understood that other motions limiters may be used, such as hydraulic or pneumatic cylinders, chains, rope, stops, or combinations thereof.

The configuration of the movable sheave assembly 40 comprising support structure 48 and plate 150 will now be discussed in greater detail.

Figure 9C:
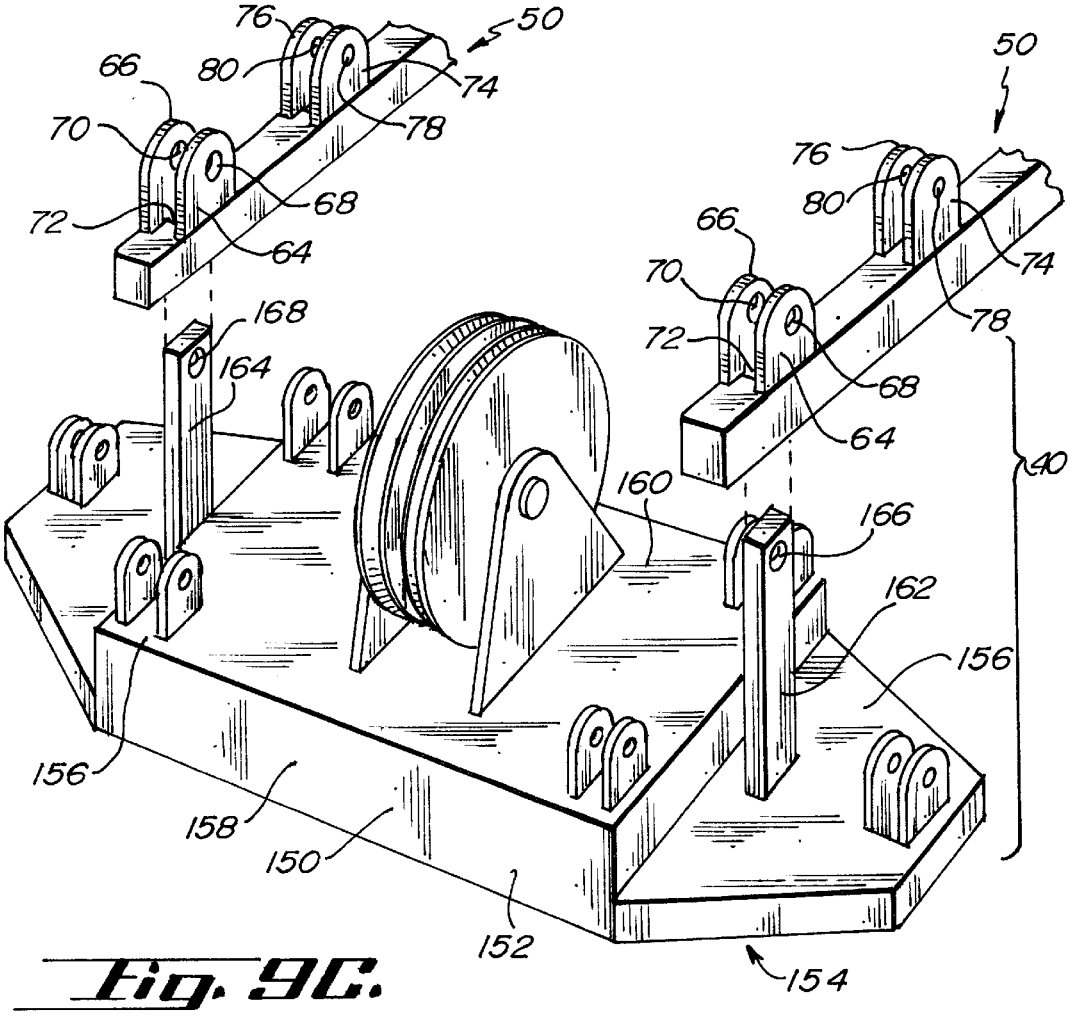
FIG. 9C is a partial exploded perspective view of the arms, plate, and sheave.
Figure 9A:
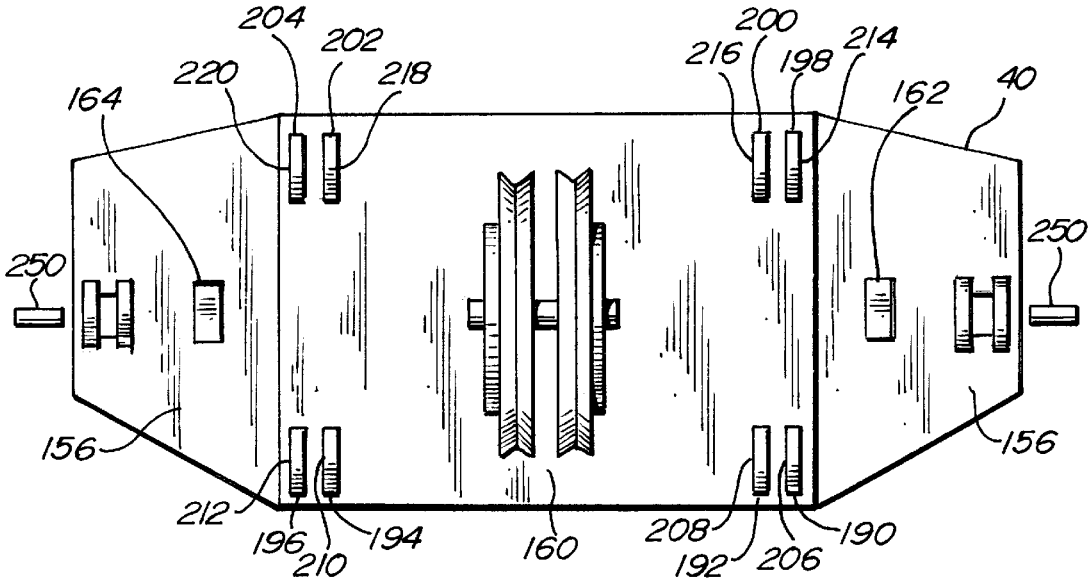
FIG. 9A is a partial top plan view of the plate with a sheave attached.
Figure 9B:
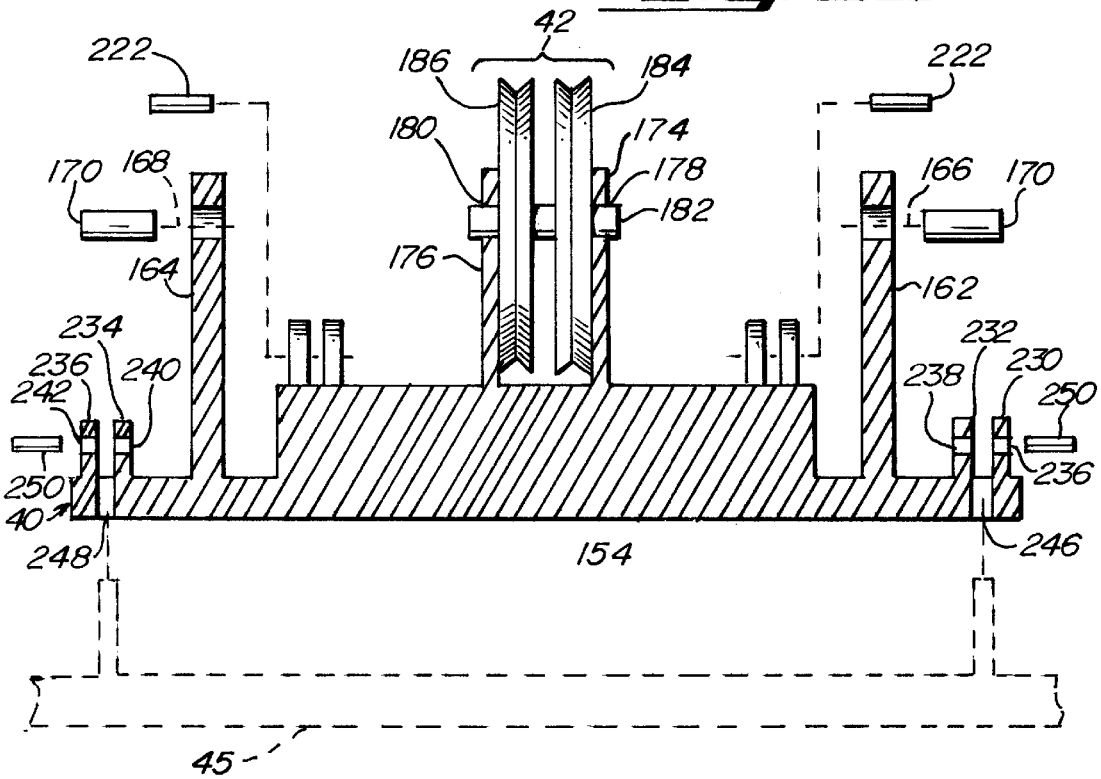
FIG. 9B is a cross-sectional side view of the plate of FIG. 9*a*.

Referring to FIGS. 9A, 9B and 9C, movable sheave assembly or yoke 40 comprises a plate 150 attached to support structure 48 by first and second arms 50. Plate 150 comprises a body 152 having a first surface 154, a second surface 156 spaced from and parallel to the first surface 154, and a third surface 160 spaced from and parallel to the second surface 156, the second and third surfaces defining a land 158 therebetween. The second surface 156 includes first and second projections 162, 164 which extend outwardly therefrom, the projections 162, 164 having apertures 166, 168 which are aligned with apertures 68, 70 in lugs 64, 68 of arms 50 and which are connected in the usual fashion by pin 170. Note the through holes 72 in arms 50 which are sized to freely admit projections 162, 164.

Attachments for the auxiliary counterweight 45 are also located on second surface 156. Second surface 156 includes flanges 230, 232, 234, and 236 which extend outwardly therefrom, the flanges having apertures 236, 238, 240, and 242 which are aligned with apertures on projections which extend outwardly from an auxiliary counterweight (not shown), and connected by pins or bolts 250. Note the through holes 246, 248 which are sized to freely admit auxiliary counterweight projections.

Turning to the third surface 160, flanges 174, 176 extend outwardly therefrom, the flanges having apertures 178, 180 which are sized to retain axle 182, with axle 182 rotatably supporting sheave 42. Although two sheaves 184, 186 are depicted, it is understood that any number of sheaves may be used, and the term "sheave" in this disclosure may be one or a plurality of pulleys.

Turning to the surface again, third surface 160 also includes a plurality of pairs of flanges 190, 192, 194, 196, 198, 200, 202, and 204 which extend outwardly therefrom, the flanges having apertures 206, 208, 210, 212, 214, 216, 218 and 220 which may be aligned with apertures in flanges F on a crane body, and connected by pins or bolts 222.

Although the use of pin connections are used throughout the invention, it is understood that other suitable attachments may be used, such as threaded bolts and nuts.

In operation, a crane and the auxiliary counterweight 45 are transported to a construction site. The crane is then stabilized by extending outriggers. The boom B is assembled and raised by a boom hoist or mast M. An auxiliary counterweight 45 is then placed adjacent the crane. The boom hoist or mast M is then lowered. After the boom hoist M is lowered, the movable sheave assembly is lowered onto the auxiliary counterweight 45, where it is releasable attached thereto. The boom hoist M is then raised to its operational configuration. The auxiliary counterweight 45 operates as an on-demand counterweight and in the absence of large loads will be self supporting.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A movable sheave assembly for use on a crane of the type having a body with forward and rearward ends, a boom extending upwardly and forwardly from the body, and a counterweight positioned rearwardly relative to the boom, the sheave assembly comprising: a support structure with a first arm pivotally attachable to the body of the crane at a pivot point; and a sheave rotatably retained by the support structure, the sheave operable in a first position wherein the support structure, including the first arm, is upright, extends upward from the pivot point, and is prevented from moving relative to the body of the crane, and in a second position wherein the support structure, including the first arm, extends rearwardly from the pivot point and the crane and has limited movement relative to the body of the crane.

2. The movable sheave assembly of claim 1, wherein said first position is adjacent to the rearward end of the body of the crane.

3. The movable sheave assembly of claim 2, wherein said second position extends beyond the rearward end of the body of the crane.

4. The movable sheave assembly of claim 1, further comprising a counterweight releasable attached thereto.

5. A crane with a movable sheave assembly, the crane comprising a body with forward and rearward ends, a boom extending upwardly and forwardly from the body, and a counterweight positioned rearwardly relative to the boom, the sheave assembly comprising: a support structure and a sheave; the sheave assembly pivotally connected to the body of the crane and pivotable between an upright first position downward to a second position extending outwardly and rearwardly from the body of the crane.

6. The crane with the movable sheave assembly of claim 5 wherein said sheave assembly is operable in a first position wherein the first and second arms are prevented from moving relative to the body of the crane, and in a second position where the first and second arms may move relative to the body of the crane.

7. The crane with the movable sheave assembly of claim 6, further comprising at least one strut having first and second ends, with one end of the strut removably attached to the body of a crane, and the other end of the strut removably attached to one of said arms.

8. The crane with the movable sheave assembly of claim 7, wherein said telescoping relation is limited.

9. The crane with the movable sheave assembly of claim 8, further comprising a second strut having first and second ends, with one end of the strut removably attached to the body of a crane, and the other end of the strut removably attached to the other of said arms.

10. The crane with the movable sheave assembly of claim 9, wherein said sheave assembly includes an attachment for releasable connecting a counterweight thereto.

11. The crane with the movable sheave assembly of claim 10, further including an auxiliary counterweight.

12. A method of converting a crane from a normal to an enhanced lifting mode the crane of the type comprising a ground-borne base, a body rotatably mounted on the ground-borne base about a vertical axis, the body having a forward end and a rearward end, and a mast extending upwardly from the body, providing the crane with a sheave assembly comprising a sheave and a support structure, the support structure linking the sheave to the body wherein the sheave is affixable in a first position adjacent the rearward end of the body, and pivotal downwardly to a second position extending beyond the rearward end of the body;

moving the sheave assembly to the second position, and attaching a counterweight to the movable sheave assembly.

13. The method of converting a crane of claim 12 wherein the step of moving the sheave assembly to the second position comprises:

erecting and rigging the boom and mast of the crane;

lowering the boom and mast of the crane to a support surface; and positioning an auxiliary counterweight adjacent the crane.

14. The method of converting a crane of claim 13, further including the step of:

attaching struts between the movable sheave assembly and the body of a crane.

15. The method of converting a crane of claim 14, further comprising the step of, raising the boom and mast of the crane from the support surface.

16. A convertible crane for lifting a load, the crane comprising: a ground-borne base, a body rotatably mounted on the ground-borne base about a vertical axis, the body having a forward end and a rearward end, a boom pivotally attached to and extending upwardly and forwardly from the forward end of the body, rope extending from an end of the mast to the load to be lifted, a movable sheave assembly attached at the rearward end of the body, a mast extending upwardly from the body and positioned intermediate the boom and the movable sheave, a pendant extending between the end of the mast and the boom, a winch positioned on the body, a running rope extending between the sheave and the mast and connecting to the winch, the winch operable to retract and play out the running rope, the sheave assembly comprising:

a sheave, a support structure rotatably supporting the sheave, the support structure pivotally attached to the body and pivotal about a horizontal axis, whereby the sheave assembly is pivotal between a first compact position with the support structure upright and a second position with the support structure extending the sheave outwardly and rearwardly from the body, the crane operable to lift loads with the sheave assembly in either the first position or the second position.

17. The convertible crane of claim 16, further comprising a counterweight attachable and detachable to the sheave assembly when the sheave assembly is in the second position.

18. The convertible crane of claim 17, wherein the counterweight has wheels for engaging the ground.

19. The convertible crane of claim 18, further comprising a limited linearly expansible strut connected between the support structure and the body of the crane whereby the sheave assembly has a limited upward movement whereby the counterweight may be lifted off the ground under high loading conditions with the sheave remaining in the second position.

* * * * *